United States Patent [19]

Hausam

[11] 4,130,149

[45] Dec. 19, 1978

[54] COFFEE DISPENSER

[76] Inventor: Leonard P. Hausam, 6801 50th Ave. N., Crystal, Minn. 55428

[21] Appl. No.: 818,568

[22] Filed: Jul. 25, 1977

[51] Int. Cl.[2] ..... B65B 1/06

[52] U.S. Cl. ..... 141/358; 222/307; 222/512

[58] Field of Search ..... 222/305, 307–308, 222/366, 440, 512, 306, 185, 181; 141/321, 322, 360–362, 358, 372, 373, 375, 108, 320

[56] References Cited

U.S. PATENT DOCUMENTS

| | | | |
|---|---|---|---|
| 245,125 | 8/1881 | Brown | 141/358 X |
| 672,782 | 4/1901 | Kinnard | 222/307 |
| 1,635,159 | 7/1927 | Bergmann | 141/373 X |
| 2,033,256 | 3/1936 | Schacher | 222/512 X |
| 2,827,083 | 3/1958 | Cortner | 141/373 X |
| 2,852,167 | 9/1958 | Lempart | 222/307 X |
| 3,177,908 | 4/1965 | Kaufman | 141/358 X |
| 3,250,303 | 5/1966 | Sollmann | 141/372 |
| 3,623,639 | 11/1971 | McShirley | 222/361 |
| 4,004,719 | 1/1977 | Weitzman | 222/366 |

*Primary Examiner*—Robert B. Reeves
*Assistant Examiner*—Charles A. Marmor
*Attorney, Agent, or Firm*—John W. Adams

[57] ABSTRACT

A coffee dispenser includes a separate measuring cup member which may be inserted in a slide track positioned below a supply container. When inserted and moved in the slide track, the measuring cup member engages and actuates a spring-loaded slide closure. The slide closure is normally in a closed position but is moved to an open position by the measuring cup member to permit granular material from the supply container to pass through a dispensing opening and into the measuring cup member. Removal of the measuring cup member causes the spring-loaded slide closure again to close, and provides the user with a measuring cup full of granular material.

8 Claims, 4 Drawing Figures

COFFEE DISPENSER

BACKGROUND OF THE INVENTION

The present invention is a dispenser of ground or granular material such as coffee. In particular the present invention accurately dispenses adjustable, predetermined amounts of coffee into a separate measuring cup.

Dispensers for various types of ground materials, such as coffee, have been developed in the past. Examples of prior art dispensers include U.S. Pat. Nos. 2,080,311 by Henley; 2,207,120 by Greig; 2,852,167 by Lempart; 3,458,092 by McConnell; and 3,758,004 by Garrett et al., and my co-pending patent application entitled "Ground Coffee Dispenser," Ser. No. 662,458, filed Mar. 1, 1976. Despite the activity in this field, there remains a need for simple, reliable dispensers of coffee and other granular materials.

SUMMARY OF THE INVENTION

The present invention is a dispenser which includes a separate measuring cup member which is manually inserted by the operator into and moved along a slide track which underlies a supply container. A spring-loaded slide closure is mounted in the slide track and is normally in a closed position underlying the dispensing opening of the supply container. The separate measuring cup has a pair of laterally extending flange elements which are received in the slide track when the measuring cup member is inserted into the slide track. The measuring cup also includes a handle at its outer end to be gripped by the operator of the dispenser to facilitate insertion into the slide track for filling and ultimate use. A bumper element on the inner end of the separate measuring cup member engages the slide closure and moves the slide closure to an open position when the measuring cup member is manually pushed into and moved along the slide track. A positive stop defines the open position of the slide closure so that the measuring cup member is positioned under the dispensing opening and receives granular material from the supply container. When the measuring cup member is removed from the slide track, the slide closure returns to the closed position which combines with the upper edge of the cup to prevent any undesirable spillage of granular material from the dispenser. The measuring cup member, when removed, contains a predetermined measured amount of granular material.

DETAILED DESCRIPTION OF THE PREFERRED EMBODIMENT

Figure 1:
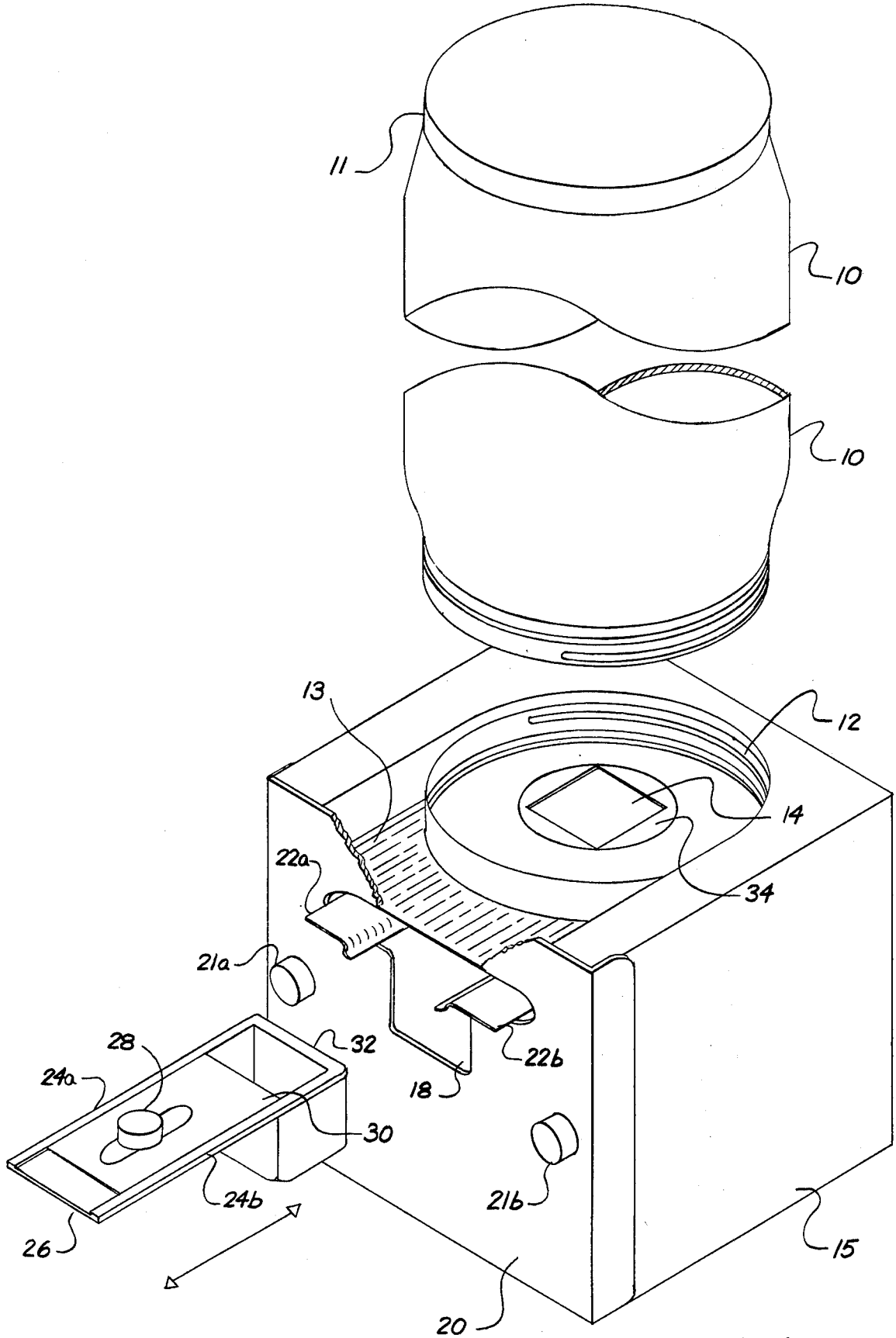
FIG. 1 is a perspective view of the dispenser of the present invention.

In the preferred embodiment of the present invention shown in FIG. 1, the dispenser includes a supply container 10 which has a threaded cap 11 to permit addition of ground coffee or other granular material without removal of supply container 10 from the dispenser. The bottom of supply container 10 is also threaded to be received by threaded closure or base 12, which is mounted on fixed plate 13. Fixed plate 13 has a dispensing opening 14 which underlies supply container 10 when it is mounted on base 12. Housing 15 contains the dispensing apparatus which dispenses ground material from supply container 10 into separate measuring cup 16, which is formed from a suitable low friction plastic material such as nylon or polyethylene.

Separate measuring cup 16 is inserted into the dispenser through an opening 18 in front panel 20. Front panel 20 is attached to the front of housing 15 by screws **21*a* and 21*b* and may be removed to permit easy cleaning. A horizontally disposed slide track assembly is formed by plate 13 and members 22*a* and 22*b*, which are fixed on the bottom side of plate 13. The slide track underlies supply container 10 within housing 15 and extends out of housing 15 through opening 18. Measuring cup 16 includes flange elements 24*a* and 24*b* which are received in the slide track formed by plate 13 and members 22*a* and 22*b* when measuring cup 16 is inserted into the slide track. Flanges 24*a* and 24*b*** are confined laterally and vertically by the slide track and slide freely back and forth therein.

When the operator of the dispenser desires granular material from supply container 10, he grasps the handle 26 of measuring cup 16 and inserts measuring cup 16 into the slide track and into housing 15 through opening 18. When the operator removes supply cup 16, the cup portion 27 of measuring cup 16 is filled with granular material from supply container 10. The operator may vary the amount of granular material received by measuring cup 16 by loosening screw 28 and adjusting the position of slide member 30, which is slidably mounted in a suitable groove in handle 26 to produce a flat coplanar top surface which slidably engages the bottom surface of fixed plate 13.

From the previous discussion, it can be seen that the dispensing of granular material from supply container 10 into measuring cup 16 is a one-hand operation which maybe performed quickly and easily by the operator. To permit this one-handed manual operation and to prevent loss of granular material from supply container 10 when measuring cup 16 is removed from the dispenser, the present invention utilizes a spring-loaded slide closure which is mounted in the slide track and which is normally held in a closed position under the dispensing opening to prevent granular material from passing out of supply container 10. Measuring cup 16 has a bumper element 32 at its front or inner end which engages the spring-loaded slide closure and moves the slide closure to an open position when measuring cup 16 is inserted into and moved along the slide track. The slide track and slide closure used in a preferred embodiment of the present invention are illustrated in detail in FIG. 2 and FIGS. 3A and 3B.

Figure 2:
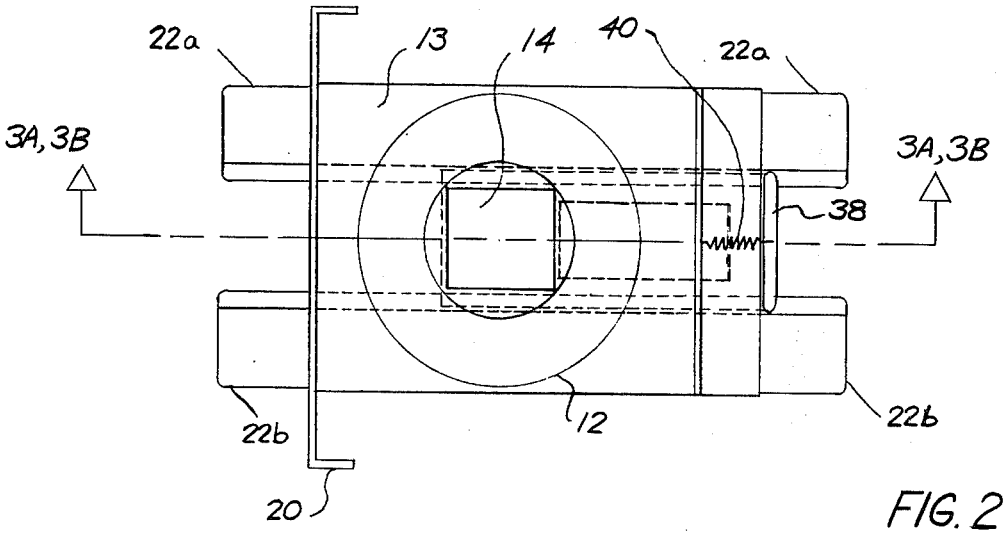
FIG. 2 is a top view of the slide track, dispensing opening, and spring-loaded slide closure utilized in a preferred embodiment of the present invention.

As shown in FIG. 2, the dispenser of the present invention includes a threaded closure or base 12 which receives supply container 10. In the bottom of base 12, which is mounted on plate 13, is an opening 34. Granular material passes from supply container 10 to measuring cup 16 through opening 34 in base 12 and dispensing opening 14 in base 13. Opening 34 is as large or larger than dispensing opening 14 so that the amount of granular material which passes is defined by dispening opening 14.

In order to prevent granular material from passing through dispensing opening 14 except when measuring cup 16 is in place, slide closure 38 is provided. Slide closure 38 is mounted in the slide track formed by plate 13 and members 22*a* and 22*b*, and is biased by spring 40 to be in a normally closed position underlying dispensing opening 14. FIG. 2 shows slide closure 38 in its normally closed position.

Figure 3A:
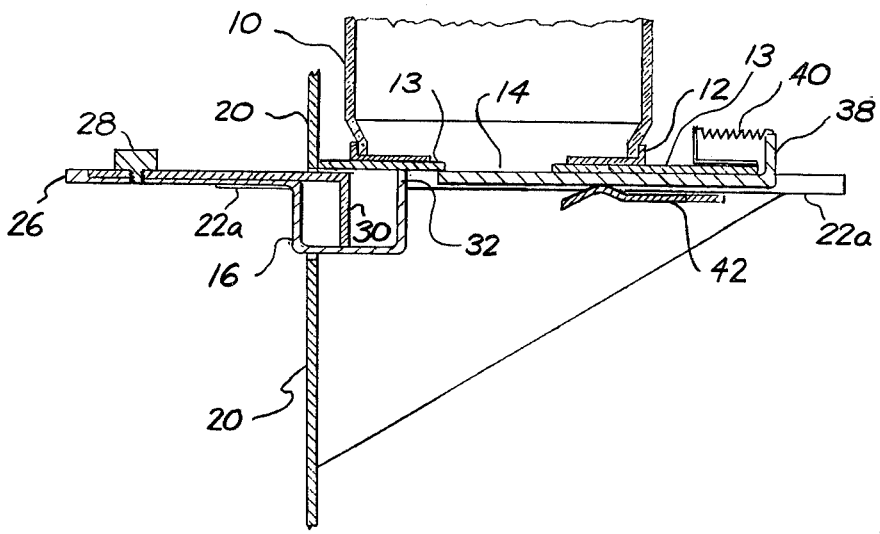
FIGS. 3A and 3B are cross-sectional views illustrating the operation of the dispenser of the present invention.
Figure 3B:
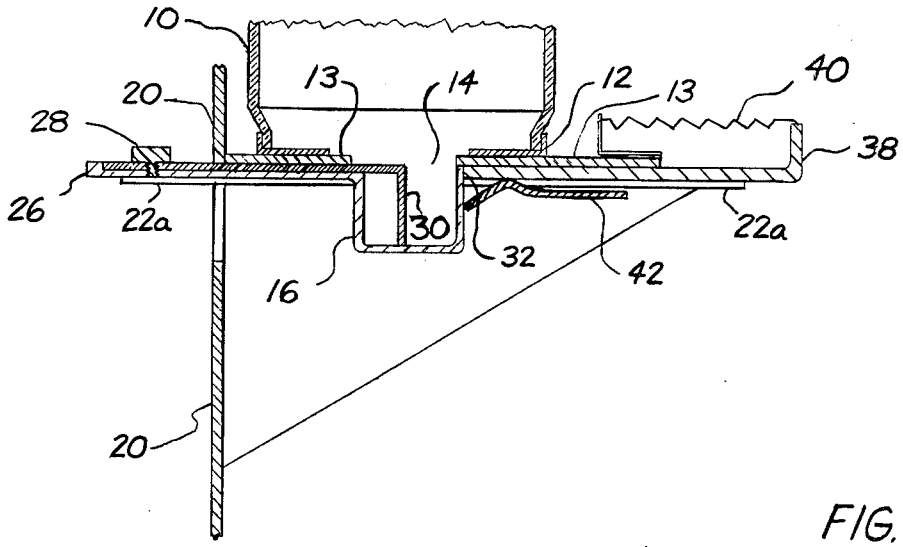

FIGS. 3A and 3B illustrate the operation of the dispenser in the present invention by showing cross-sectional views taken along line 3A, 3B–3A, 3B of FIG. 2. In FIG. 3A, measuring cup 16 is shown in a position in which bumper element 32 has not yet engaged slide closure 38. As shown in FIG. 3A, slide closure 38 remains in its normally closed position and prevents granular material from passing through dispensing opening 14.

In both FIGS. 3A and 3B, leaf spring 42 puts pressure on slide closure 38 to maintain slide closure 38 in close surface-to-surface relationship with plate 13. This prevents granular material from building up between slide closure 38 and plate 13 and clogging the dispenser.

In FIG. 3B, measuring cup 16 has been inserted and pushed along the slide track until it reaches a position defined by a positive stop, in this case leaf spring 42. As measuring cup 16 was pushed along the slide track, bumper element 32 engaged slide closure 38 and overcame the force of spring 40 to push slide closure 38 to its open position. In the open position, granular material from supply container 10 passes through dispensing opening 14 into the cup portion of measuring cup 16.

When measuring cup 16 is withdrawn from the slide track, spring 40 will urge slide closure along the slide track to maintain contact with bumper element 32 until slide closure 38 returns to its normally closed position which is illustrated in 3A. When measuring cup 16 is removed, it will contain a predetermined measured quantity of granular material from supply container 10. The amount of this material depends upon the position of movable element 30, which varies the size of cup portion 27 of measuring cup 16.

It can be seen, therefore, that the present invention provides simple yet accurate dispensing of predetermined quantities of granular material to a separate measuring cup. This dispensing is achieved with a one-hand operation by the operator. No spilling of granular material occurs due to the combined action of measuring cup 16, slide closure 38, spring 40, the positive stop, leaf spring 42, and the slide track formed by plate 13 and members 22*a* and 22*b*.

Although the present invention has been described in reference to preferred embodiments, workers skilled in the art will recognize that changes may be made in form and detail without departing from the spirit and scope of the invention. For example, although leaf spring 42 was shown in FIG. 3B as forming the positive stop, the back wall of housing 15 may act as a positive stop to the rear end of slide closure 38, or adjusting screw 28 may act as a positive stop when it reaches front panel 20.

What is claimed is:

1. A dispenser for dispensing a measured volume of granular material, the dispenser comprising:

a supply container for containing the granular material;

a plate fixed at the bottom of the supply container and having a dispensing opening;

a pair of horizontally disposed slide rails fixed to a bottom surface of the plate on opposite sides of the dispensing opening, the slide rails and the bottom surface of the plate together defining a horizontally disposed slide track underlying the supply container, the slide rails extending in front of a front edge of the plate to form a guiding path into the slide track;

slide closure means mounted in the slide track and positioned to slide along the bottom surface of the plate in surface to surface contact therewith;

spring means for normally holding the slide closure means in closed position underlying the dispensing opening;

a separate measuring cup member for insertion into and movement along the slide track, the measuring cup member having a handle on the outer end thereof, a pair of laterally extending flange elements on the sides thereof adapted to be received in the slide track and to position the top edges of the measuring cup member in sliding coplanar engagement with the bottom surface of the plate when the measuring cup member is inserted into the slide track, and a bumper element on the inner end thereof for engaging the slide closure means and moving the slide closure means to an open position when the measuring cup member is inserted into and moved along the slide track;

a base for receiving and holding the supply container at the bottom thereof, the base having an opening through which a granular material may pass, wherein the plate is fixed at the bottom of the base and the dispensing opening corresponds at least in part to the opening in the base;

a housing for containing the base, the plate, the slide rails, the slide closure means, and the spring means;

a removable front panel connected to the housing and having an opening therein through which the measuring cup member may be inserted, the removable front panel being connected to the plate and the slide rails whereby the base, the plate, the slide rails, the slide closure means, and the spring means are removed from within the housing when the front panel is removed from the housing; and stop means for positively defining the open position of the slide closure means to position the measuring cup member under the dispensing opening to receive granular material from the supply container.

2. The structure set forth in claim 1 wherein the supply container has a removable top to permit refilling of the same.

3. The structure set forth in claim 1 wherein the measuring cup member has an adjustable insert for varying the size of the cup compartment of the cup member and the amount of granular material dispensed therein.

4. The structure set forth in claim 3 wherein the handle has a groove in its top surface, wherein the adjustable insert has an extension portion slidably received in the groove, and wherein the cup member further includes means for releasably clamping the handle and the extension portion of the adjustable insert in the desired adjusted position.

5. The structure set forth in claim 1 wherein the laterally extending flange elements are formed from a low friction plastic material.

6. The structure set forth in claim 1 and further comprising:

leaf spring means for applying an upward force to a bottom surface of the slide closure means to maintain a top surface of the slide closure means in surface-to-surface contact with the bottom surface of the plate.

7. The structure set forth in claim 1 wherein the supply container has a threaded lower portion and wherein the base is threaded to receive and hold the threaded lower portion.

8. The structure set forth in claim 1 wherein the slide rails extend partially out of the housing through the opening in the front panel.

* * * * *